US006333737B1

(12) United States Patent
Nakajima

(10) Patent No.: US 6,333,737 B1
(45) Date of Patent: Dec. 25, 2001

(54) LIQUID CRYSTAL DISPLAY DEVICE HAVING INTEGRATED OPERATING MEANS

(75) Inventor: Yoshiharu Nakajima, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/271,210

(22) Filed: Mar. 17, 1999

(30) Foreign Application Priority Data

Mar. 27, 1998 (JP) ..... P10-080617

(51) Int. Cl.[7] ..... G09G 5/00; G09G 3/36
(52) U.S. Cl. ..... 345/205; 345/90
(58) Field of Search ..... 345/90, 92, 205, 345/206, 76

(56) References Cited

U.S. PATENT DOCUMENTS 5,339,090 * 8/1994 Crossland et al. ..... 345/90
5,945,972 * 8/1999 Okumura et al. ..... 345/98
5,977,940 * 11/1999 Akiyama et al. ..... 345/94
5,990,988 * 11/1999 Hanihara et al. ..... 349/48

* cited by examiner

*Primary Examiner*—Jeffery Brier
*Assistant Examiner*—Ryan Yang
(74) *Attorney, Agent, or Firm*—Ronald P. Kananen; Rader, Fishman & Grauer PLLC

(57) ABSTRACT

In a liquid crystal display device including a display area having a liquid crystal layer between first and second substrates disposed to confront each other, the display area comprising a number of pixels, and an element for driving the liquid crystal layer of each pixel for display being provided on the surface of the first substrate at the liquid crystal layer side of each pixel, in addition to the element, an operating unit for performing predetermined operational processing on the basis of data input to each pixel and outputting the processed data is provided on the surface of the first substrate at the liquid crystal layer side of each pixel. An input register circuit, a memory and an output register circuit may be provided to each pixel. With this structure, the liquid crystal display device has not only the image display function, but also the operating function, whereby the productivity can be enhanced, the manufacturing cost can be reduced and the liquid crystal display device can be designed in compact size and light weight.

25 Claims, 2 Drawing Sheets

LIQUID CRYSTAL DISPLAY DEVICE HAVING INTEGRATED OPERATING MEANS

BACKGROUND OF THE INVENTION

1. Field of the Invention

The present invention relates to a liquid crystal display device, and particularly a liquid crystal display device having an operation processing function.

2. Description of the Related Art

A conventional liquid crystal display device (LCD) comprises a pair of glass substrates and a liquid crystal layer interposed therebetween. A pixel electrode, a switching element and a storage capacitor are provided for every pixel on one of the pair of glass substrates, and data to display pixels (hereinafter referred to as "display data") are input to the pixel electrodes through the switching elements, whereby the liquid crystal layer on desired pixels is driven to form an image. Further, signal charges which are first input to pixel electrodes are held by the storage capacitors until next signal charges are input.

However, the conventional liquid crystal display device is fabricated by integrating only the switching elements and storage capacitors as elements for actually driving the liquid crystal layer of the respective pixels as described above, and thus it has merely the function of displaying display data corresponding the image format thereof.

Accordingly, in order to convert the image format, improve the image quality, perform the image processing of compressed signals, etc., an external LSI (large scale integrated circuit) having the above-described image processing function must be prepared and installed in a liquid crystal display device. As a result, the number of mounting steps is increased and the productivity of the liquid crystal display is reduced. In addition, a number of materials is needed as external elements to manufacture external LSIs, so that the manufacturing cost is extremely increased.

Furthermore, since the external LSI is installed in the liquid crystal device in such a manner as to be secured to the liquid crystal device as a separate element, restriction is imposed on compactness in size and lightness in weight. Still further, since the signal of display data of the liquid crystal display device is processed by the external LSI and then transmitted to the liquid crystal display device again, restriction is imposed on increase of image processing speed.

SUMMARY OF THE INVENTION

The present invention has be en implemented in view of the foregoing problem, and according to a first aspect of the present invention, there is provided a liquid crystal display device comprising a first substrate having a display area, a second substrate joined to the first substrate through a predetermined gap, and a liquid crystal layer filled and held in the gap between the first substrate and the second substrate located at the opposite side to the first substrate, wherein the display area comprises a number of pixels; an element for driving the liquid crystal layer of each pixel for display is provided on the surface of the first substrate at the liquid crystal display side of each pixel; and operating means for performing predetermined operational processing on data input to each pixel and outputting processed data is provided on the surface of the first substrate at the liquid crystal layer side of the pixel in addition to the element.

According to another aspect of the present invention, there is provided a display device comprising a number of pixels, and a circuit for driving the pixels, wherein each of the pixels has a display element and an operating means, the operating means performs predetermined operational processing on the basis of data input thereto and outputting the processed data.

According to the present invention, in addition to the element for displaying pixels, the operating means for performing the predetermined operational processing on the data input to each pixel and outputting the processed data is provided on the surface of the first substrate at the liquid crystal layer side of each pixel, so that each pixel is provided with the operating function. Accordingly, no external LSI is needed, and a work of mounting the external LSI in the liquid crystal display device is unnecessary. Further, if each pixel is provided with the output means for outputting data for displaying pixels (display data) on the basis of the processed data in addition to the operating means, the operational processing can be immediately performed on the data input to a pixel from the external or adjacent pixels to display the pixel concerned. Still further, the present invention is applied not only to the liquid crystal display device, but also to other display devices such as organic EL (electroluminescence) elements, etc.

DETAILED DESCRIPTION OF THE PREFERRED EMBODIMENT

A preferred embodiment according to the present invention will be described with reference to the accompanying drawings.

Figure 1:
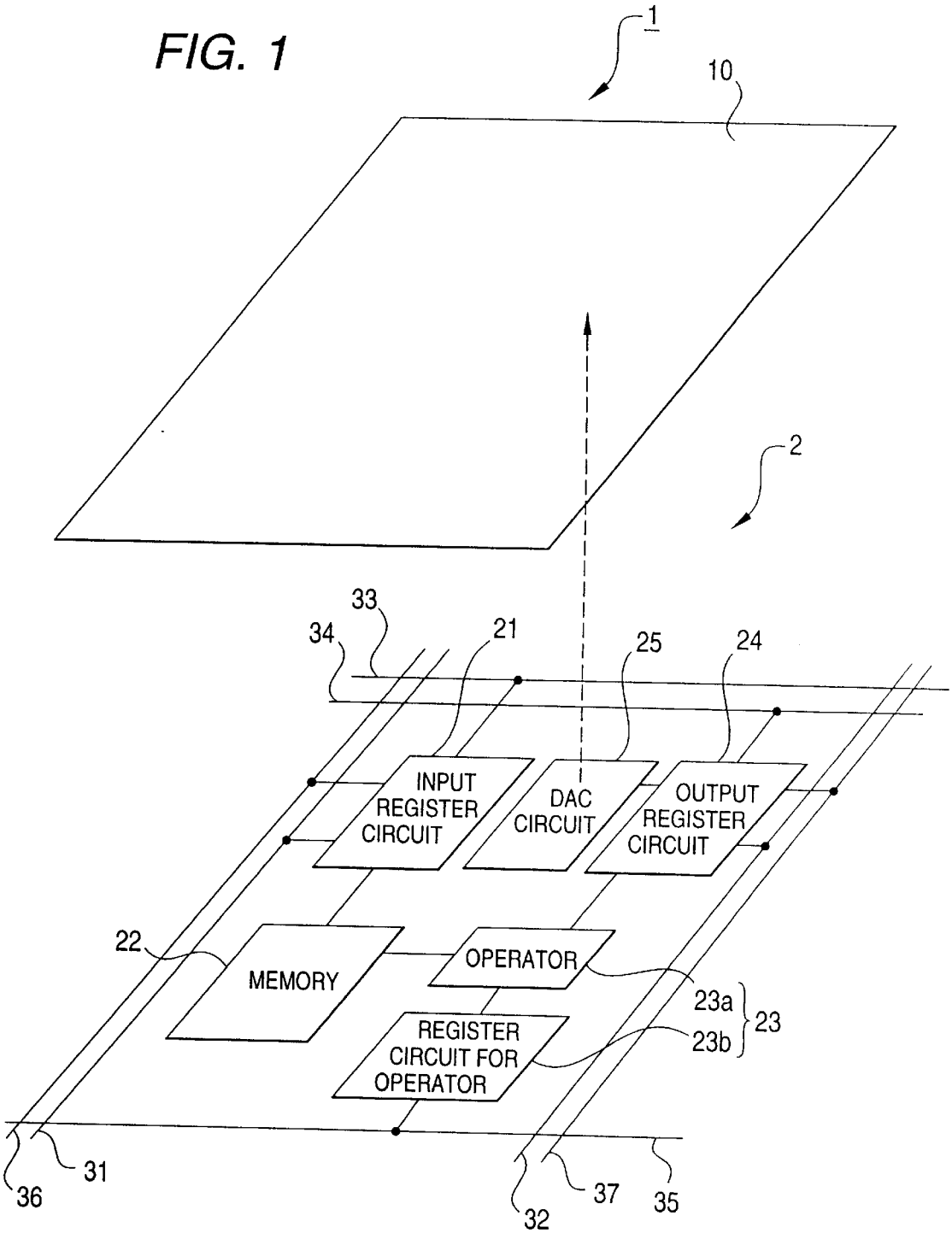
FIG. 1 is diagram showing the main part of an embodiment of a liquid crystal display device according to the present invention, and specifically shows the main part of a pixel in a display area.
Figure 2:
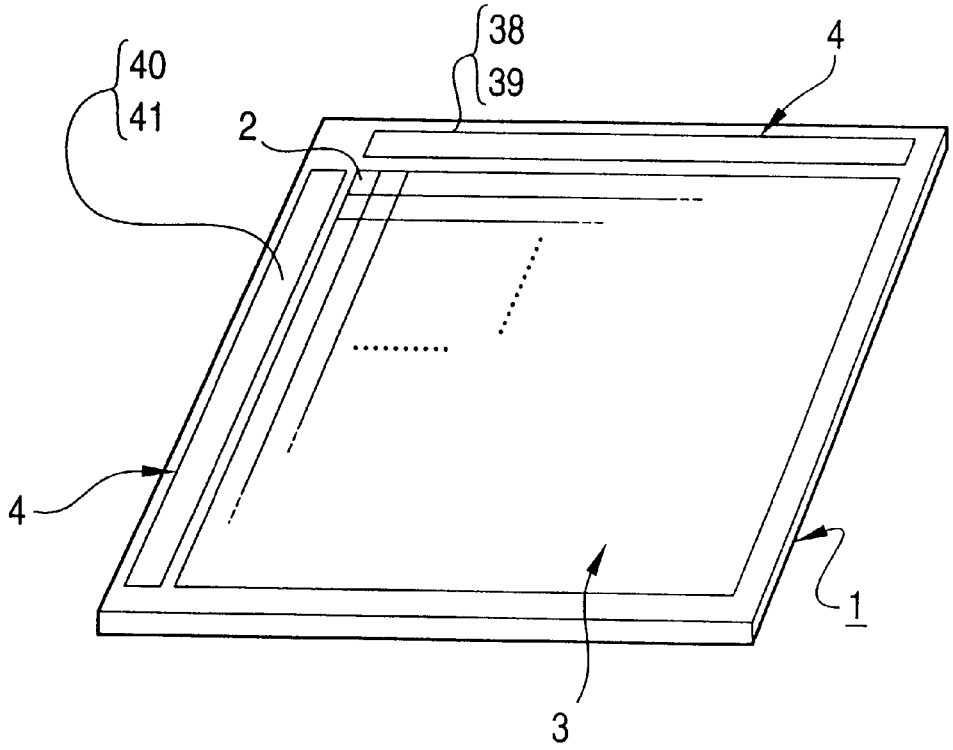
FIG. 2 is a perspective view showing the embodiment of the liquid crystal display device according to the present invention.
Figure 3:
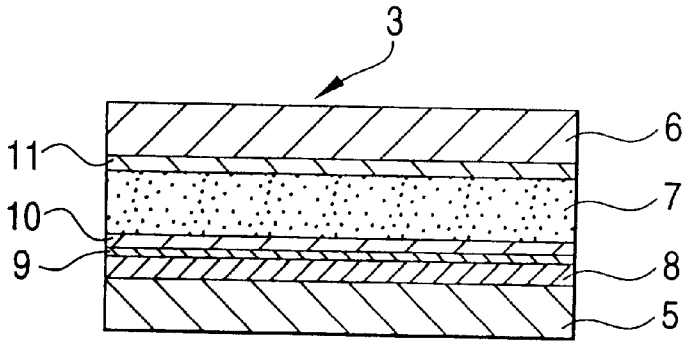
FIG. 3 is a cross-sectional view showing the embodiment of the liquid crystal display device according to the present invention.

FIG. 1 is a diagram showing the main part of a liquid crystal display device according to an embodiment of the present invention, and specifically FIG. 1 shows the main part of a pixel in a display area. FIG. 2 is a perspective view showing the liquid crystal display device according to the embodiment, and FIG. 3 is a cross-sectional view showing the liquid crystal display device according to the embodiment.

The liquid crystal display device 1 shown in FIG. 2 is of a reflection type for displaying an image with reflection light, and comprises a display area 3 comprising a number of pixels 2, and a peripheral area 4 surrounding the display area 3. The display area 3 is designed to be substantially rectangular in plan view, and comprises first and second substrates which are formed of the same material such as glass or the like and disposed so as to confront each other, and a liquid crystal layer 7 formed of nematic liquid or the like as shown in FIG. 3.

As in the case of the conventional liquid crystal display device, an element-formed layer 8 having driving elements for driving the liquid crystal layer 7 of the respective pixels 2 for display, storage capacitors, source electrode lines and gate electrode lines is provided on the surface of the first substrate 5 at the liquid crystal layer 7 side. The driving elements and the storage capacitors are provided at every pixel 2, and the source electrode lines and the gate electrode lines are disposed in a matrix form so as to partition the respective pixels 2 in the same manner as the conventional liquid crystal display device. In this embodiment, each driving element is formed of a polysilicon thin film transistor (hereinafter referred to as "polysilicon TFT") having an active layer of polysilicon. However, the material of the driving element is not limited to polysilicon, and may be formed of another active element.

In order to provide each pixel 2 with an operating function, not only the driving element and the storage capacitor, but also an input register circuit 21, a memory 22, an operation circuit 23, an output register circuit 24 and a digital-to-analog conversion circuit (hereinafter referred to as "DAC circuit") 25 are integrated on the element-formed layer 8 of each pixel as shown in FIG. 1, for example. However, the circuit design is not limited to the above-described construction, and may be designed to be achieved by a desired circuit. In this embodiment, the various types of circuits described above are formed by using the same types of polysilicon TFTs as the driving elements. In FIGS. 1 to 3, the driving elements, the storage capacitors, the source electrode lines and the gate electrode lines are omitted from the illustration.

On the element-formed layer 8 are formed a first data input line 31 of Al or the like, a first data output line 32 of Al or the like, an input control line 33 of polycide or the like, an output control line 34 of polycide or the like, an operating unit control line 35 of polycide or the like, a second data input line 36 of Al or the like and a second data output line 37 of Al or the like as in the case of the source electrode lines of Al or the like and the gate electrode lines of polycide or the like. In FIG. 1, the input control line 33, the output control line 34 and the operating unit control line 35 are provided in the horizontal direction of the display area 3, that is, substantially parallel to the gate electrode lines, and the first data input line 31, the first data output line 32, the second data input line 36 and the second data output line 37 are provided in the vertical direction of the display area 3, that is, substantially parallel to the source electrode lines.

The input register circuit 21 formed of polysilicon TFT serves as input means of the present invention, and connected to each of the first data input line 31, the second data input line 36 and the input control line 33. The input operation of the input register circuit 21 is controlled on the basis of a control signal from the input control line 33 so that data are input thereto from any one of the first data input line 31 and the second data input line 36 or from both the first data input line 31 and the second data input line 36.

The input register circuit 21 is provided with a selection switch (not shown) to enable selection of data input from any one of the first data input line 31 and the second data input line 36. The input register circuit 21 has a function of outputting input data to a memory 22.

The memory 22 is formed of polysilicon TFT or the like, and serves as storage means of the present invention. It comprises a RAM for storing the data input. The operating circuit 23 serves as the operating means of the present invention, and has a function of performing a predetermined operation on the basis of data which are input from the external to display pixels (hereinafter referred to as "display data") and outputting the data thus obtained to the output register circuit 24.

The operating circuit 23 is formed of polysilicon TFT, and comprises an operating unit 23*a* and a register circuit 23*b* for the operating unit. The operating unit 23*a* has a function of reading out data such as detection data or the like stored in the memory 22 and performing a predetermined operation on the basis of the data thus read-out. The operating unit register circuit 23*b* is connected to an operating unit control line 35, and a control signal is transmitted from the operating unit control line 35 through the operating unit register circuit 23*b* to the operating unit 23*a*. The operating unit 23*a* performs the predetermined operation on the basis of the control signal and outputs the data thus obtained to the output register circuit 24, or outputs the data to the output register circuit 24 without performing any operation.

The output register circuit 24 is formed of polysilicon TFT, and serves as output means of the present invention. It has a function of outputting display data or the like on the basis of data obtained by the operation processing in the operating unit 23*a*. Here, the output register circuit 24 is connected to the first data output line 32, the second data output line 37 and the DAC circuit 25, and also connected to the output control line 34. Accordingly, the data output is controlled so that the data from the operating unit 23*a* is output to any one of the first data output line 32, the second output line 37 and the DAC circuit 25 of polysilicon TFT on the basis of the control signal from the output control line 34. The DAC circuit 25 has a function of converting digital data from the output register circuit 24 to analog data and outputting the analog data to a pixel electrode as described later.

The first data input line 31 is connected to an input circuit described later, and the second input line 36 is connected to the output register circuit 24 of another adjacent pixel 2. The first data output line 32 is connected to a final output circuit as described later, and the second data output line 37 is connected to the input register circuit 21 of another adjacent pixel 2. The input control line 33, the output control line 34 and the operating unit control line 35 serve as constituent elements of a third controller, a second controller and a first controller, respectively, and connected to a control register circuit and a control circuit described later.

A pixel electrode 10 to display an image is provided through an insulating film 9 formed of organic film at the liquid crystal layer 7 side of the element-formed layer 8 provided with the above-described various types of function circuits as shown in FIGS. 1 and 3. The pixel electrode 10 is formed of a metal layer of Aluminum (Al) or the like which also serves as a reflection plate for reflecting light incident to the display area 3, and a pattern is formed every pixel 2 as in the case of the related art. The second substrate 6 formed of glass or the like is provided with a color filter layer (not shown), a common electrode 11 of ITO (indium titan oxide) or the like, etc. on the surface thereof at the side of the liquid crystal layer 7 formed of nematic liquid crystal or the like. The insulating film 9 is not necessarily needed. However, it may be used in association with the type of the liquid crystal of the liquid crystal layer 7.

As described above, in the display area 3, the pixel electrode 10 serving as the reflection plate is disposed nearer to the liquid crystal layer 7 side than the element-formed layer 8. Therefore, it is unnecessary to design the liquid crystal display device in such a structure that light transmits through the element-formed layer 8, and the image display suffers no effect even when various elements such as the operating circuit 23, etc. and the signal lines such as the first data input line 31, etc. are provided in the element-formed layer 8.

Further, the peripheral area 4 is provided with scan circuits (not shown) for the source electrode lines and the gate electrode lines, and also it is provided with an input circuit 38 formed of polysilicon TFT or the like, a final output circuit 39, a control register circuit 40 and a control circuit 41 as shown in FIG. 2. The input circuit 38 temporarily holds display data composed of digital signals input from the external, and outputs the display data to the first data input line 32. The final output circuit 39 collectively outputs the data obtained through the operation in the operating circuit 23 to the external.

A control register circuit 40 and a control circuit 41 serve to control the input register circuit 21, the output register circuit 24 and the operating circuit 23 of each pixel 2, and constitute the third controller, the second controller and the first controller of the present invention in combination with the input control lines 33, the output control lines 34 and the operating unit control lines 35.

That is, the control register circuit 40 and the control circuit 41 controls the data input to the input register circuit 21 of each pixel 2 through the input control line 33, controls the data output from the output register circuit 24 of each pixel through the output control line 34, and controls the operating processing in the operating unit 23 through the operating unit control line 35. The control circuit 41 controls the control register circuit 40, and also has a switch control function of controlling the selection switch of the input register circuit 21 as described above.

In FIG. 2, the input circuit 38 and the final output circuit 39 are provided in the peripheral area 4 of the upper-side peripheral portion of the display area 3, and the control register circuit 40 and the control circuit 41 are provided in the peripheral area 4 of the left-side peripheral portion of the display area 3. However, these circuits may be disposed at any position in the peripheral area 4 and are not limited to an example of FIG. 2.

That is, the locations of these circuits are not limited to specific positions. Thereafter, the second substrate 6 and the first substrate 5 which are formed of glass are attached to each other, and then the liquid crystal layer 7 is sealed in the gap between the first and second substrates, thereby completing the liquid crystal display device.

In the liquid crystal display device 1 thus constructed, the input register circuit 21 inputs display data from the external through the first data input line 31 in response to the control signal from the input control line 33, or inputs data from an adjacent pixel 2 through the second data input line 36. Alternatively, it inputs data from both the first data input line 31 and the second data input line 36. The data thus input are composed of digital signals. The data thus input are output to the memory 22.

Subsequently, the operating unit 23*a* reads out data stored in the memory 22. The operating unit 23*a* performs a predetermined operation on the basis of the read-out data in response to the control signal transmitted from the operating unit control line 35 through the operating unit register circuit 23*b*, and outputs the data thus obtained to the output register circuit 24. Alternatively, the operating unit 23*a* outputs the data to the output register circuit 24 without performing any operation.

The output register circuit 24 outputs the display data to the DAC circuit 25, for example, on the basis of the data from the operating unit 23*a* in response to the control signal from the output control line 34. The DAC circuit 25 converts the digital display data from the output register circuit 24 to analog data, and outputs the analog data thus obtained to the pixel electrode 10 side to display the corresponding pixel 2. Alternatively, the output register circuit 24 outputs the data from the operating unit 23*a* to the first data output line 32 or the second data output line 37 in response to the control signal from the output control line 34.

As described above, in the liquid crystal display device 1 of this embodiment, each pixel 2 is provided with the operating circuit 23 and thus has an operating function. Therefore, various operational processing can be performed on data input to each pixel 2 without preparing an external LSI. As a result, the present invention does not need any preparation of an external LSI and any LSI-securing work which have been needed for the conventional liquid crystal display.

In each pixel 2, various image processing such as conversion of the pixel number, decoding of compressed signals, improvement in image quality, etc. can be performed by the operating function which can perform various operational processing. Further, since the input register circuit 21, the memory 22, the operating circuit 23, the output register circuit 24, the DAC circuit 25, etc. are provided in the same pixel 2, so that data input to each pixel 2 can be instantaneously subjected to operational processing to obtain a digital signal and then the digital signal is converted to an analog signal to display information of the analog signal on the pixel 2.

The operating means 23 as well as the driving element can be formed in the element-formed layer 8, and also the operating means 23 is formed by using the same material as the driving element (i.e., the polysilicon TFT), so that the formation of the element-formed layer 8 can be efficiently performed even when the number of steps of the element-formed layer 8 is increased to some degree. Accordingly, the number of mounting steps and the number of constituent materials can be reduced, and the element-formed layer 8 can be efficiently formed, so that the productivity of the liquid crystal display device 1 can be enhanced and the manufacturing cost can greatly be reduced. Further, since no external LSI is needed, the liquid crystal display device can be designed in compact size and light weight.

Accordingly, according to the present invention, there can be provided the liquid crystal display device 1 which has the operating function as well as the image display function, operates at very high speed and is manufactured at low cost in compact size and light weight. Further, the element having the operating function is formed in each pixel 2 and thus the image processing such as improvement in image quality, etc. can be performed with suppressing increase in area per pixel. Therefore, the liquid crystal display device 1 is very effectively used for a device which needs high image quality although an image obtained thereby is small, such as a desktop monitor, a portable compact liquid crystal television, a navigation system, a view finder or the like.

In this embodiment, all of the operating means, the output means, the storage means and the input means are provided to each pixel. However, the present invention is not limited to the above mode. That is, there may be provided a liquid crystal display device in which only the operating means, the combination of the operating means and the output means, the combination of the operating means, the output means and the storage means or any combination of the above means may be selected and provided to each pixel in association with the function added to the liquid crystal display device. Of course, the above combination may be applied to other display devices.

Further, any combination of the input circuit and the final output circuit (for example, only the input circuit, the combination of the input circuit and the final output circuit, and the final output circuit) or any combination of the first controller, the second controller and the third controller in place of any combination of the input circuit and the final output circuit may be used in association with the combination of the above means. Besides, any combination of the input circuit, the final output circuit, the first controller, the second controller and the third controller may be used in association with the combination of the above means. That is, the various modifications may be made in association with the functions to be added to the liquid crystal display device.

As described above, according t o the liquid crystal display device and the display device of the present invention, each pixel is provided with the operating function by the operating means provided on the surface of the first substrate at the liquid crystal layer side of each pixel. Therefore, preparation of an external LSI and a securing work of the LSI are not needed. Accordingly, the number of mounting steps and the constituent materials can be reduced, thereby implementing the enhancement in productivity of the liquid crystal display device and the display device, the great reduction in manufacturing cost and the compact and light design. Further, various operational processing can be performed on data input to each pixel by the operating function of the pixel, so that the image processing such as the improvement of image quality, etc. can be performed. Still further, if the output means for outputting data to display an image on the basis of data from the operating means is provided to each pixel in addition to the operating means, the operational processing can be immediately performed on the data input to each pixel to display an image, so that there can be provided a liquid crystal display device and a display device in which a high-quality image can be obtained and the processing speed is high.

What is claimed is:

1. A liquid crystal display device comprising:

a first substrate having a display area;

a second substrate joined to the first substrate through a predetermined gap; and a liquid crystal layer filled and held in the gap between said first substrate and said second substrate located at the opposite side to said first substrate, wherein said display area comprises a plurality of pixels;

an element for driving the liquid crystal layer of each pixel for display is provided on the surface of said first substrate at the liquid crystal display side of each pixel; and operating means for performing predetermined operational processing on data input to each pixel and outputting processed data, said operating means comprising an operating unit which reads data from a memory, a register circuit connected to a control line, said operating means being provided on the surface of said first substrate at the liquid crystal layer side of said pixel in addition to said element.

2. The liquid crystal display device as claimed in claim 1, wherein output means for outputting, on the basis of processed data, data for displaying a pixel which performs the operational processing is provided on the surface of said first substrate at the liquid crystal layer side of said pixel.

3. The liquid crystal display device as claimed in claim 1, wherein storing means for storing data input to each pixel is provided on the surface of said first substrate at the liquid crystal layer side of said pixel, said operating means performs the predetermined operational processing on the basis of the data stored in said storage means.

4. The liquid crystal display device as claimed in claim 3, wherein input means for receiving both data for displaying a pixel and data from an adjacent pixel and outputting the data input thereto to said storage means is provided on the surface of said first substrate at the liquid crystal layer side of said pixel.

5. The liquid crystal display as claimed in claim 4, wherein an input circuit for receiving data for displaying a pixel and outputting the data thus input to said input means is provided on the peripheral portion of said display area.

6. The liquid crystal display device as claimed in claim 1, wherein a final output circuit for collectively outputting data output from respective pixels to the external is provided on the peripheral portion of said display area.

7. The liquid crystal display device as claimed in claim 1, further including a first controller for controlling said operating means of each pixel.

8. The liquid crystal display device as claimed in claim 2, further including a second controller for controlling said output means of each pixel.

9. The liquid crystal display device as claimed in claim 4, further including a third controller for controlling said input means of each pixel.

10. The liquid crystal display device as claimed in claim 9, wherein said input means has a selection switch for allowing one of said data for displaying said pixel or said data from the adjacent pixel to be selected as the data input to said input means, where said third controller has a switch control function for controlling said selection switch.

11. The liquid crystal display device as claimed in claim 1, wherein a reflection plate for reflecting light incident to said display area is provided between both of said element and said operating means and said liquid crystal layer on said first substrate.

12. The liquid crystal display device as claimed in claim 1, wherein said element comprises a polysilicon thin film transistor having an active layer of polysilicon, and said operating means is formed of said polysilicon thin film transistor.

13. A display device comprising:

a plurality of pixels; and a circuit for driving said pixels, wherein each pixel of said plurality of pixels includes:

a digital-to-analog circuit, and an operating means, said operating means comprising:

an operating unit which reads data from said a memory, and a register circuit connected to a control line.

14. The display device as claimed in claim 13, wherein output means for outputting, on the basis of the processed data, data for displaying a pixel which performs the operational processing is provided on the surface of each pixel.

15. The display device as claimed in claim 13, wherein storage means for storing data input to each pixel is provided on the surface of said pixel, and said operating means performs the predetermined operational processing on the basis of the data stored in said storage means.

16. The display device as claimed in claim 15, wherein said input means is provided on the surface of each pixel.

17. The display device as claimed in claim 16, wherein an input circuit which receives data for displaying pixels and outputs the data to said input means is provided to said input means for driving said pixels.

18. The display device as claimed in claim 13, wherein a final output circuit for collectively outputting the data output from said pixels is provided to said circuit for driving said pixels.

19. The display device as claimed in claim 13, further including a first controller for controlling said operating means of each pixel.

20. The display device as claimed in claim 14, further including a second controller for controlling said output means of each pixel.

21. The display device as claimed in claim 16, further including a third controller for controlling said input means of each pixel.

22. The display device as claimed in claim 21, wherein said input means has a selection switch for allowing one of either said data for displaying pixels or data from the adjacent pixel to be selected as the data input to said input means, and said third controller has a switch control function for controlling said selection switch.

23. The display device as claimed in claim 13, wherein said element comprises a thin film transistor, and said operating means is formed of said thin film transistor.

24. The display device as claimed in claim 23, wherein said thin film transistor is composed of a polysilicon thin film transistor.

25. A display device comprising:

a plurality of pixels, each pixel of said plurality of pixels include:

a input register circuit:

memory connected to said input register circuit;

an operating circuit having an operating unit which reads data from said memory, and a register circuit connected to a control line;

an output register connected to said operating circuit; and a digital-to-analog circuit connected to said output register.

* * * * *